United States Patent [19]

Hamilton

[11] 4,324,583

[45] Apr. 13, 1982

[54] SUPERSONIC INJECTION OF OXYGEN IN CUPOLAS

[75] Inventor: Jarrette A. Hamilton, Sauk Village, Ill.

[73] Assignee: Union Carbide Corporation, Danbury, Conn.

[21] Appl. No.: 226,553

[22] Filed: Jan. 21, 1981

[51] Int. Cl.[3] ..... C21B 11/02

[52] U.S. Cl. ..... 75/43; 266/900

[58] Field of Search ..... 75/43, 44 R, 44 S, 65 R; 266/900, 265, 266

[56] References Cited

U.S. PATENT DOCUMENTS

| | | | |
|---|---|---|---|
| 3,089,766 | 5/1963 | De Wald et al. | 75/43 |
| 3,547,624 | 12/1970 | Gray | 75/43 |

FOREIGN PATENT DOCUMENTS

| | | | |
|---|---|---|---|
| 914904 | 1/1963 | United Kingdom | 75/43 |
| 1006274 | 9/1965 | United Kingdom | 75/43 |

*Primary Examiner*—M. J. Andrews

*Attorney, Agent, or Firm*—Stanley Ktorides

[57] ABSTRACT

The efficiency of cupola operation is increased by the injection of a gas having an oxygen concentration of from about 20 to 100 volume percent, separate from the air blast, directly to the burning coke, at supersonic velocity.

11 Claims, 1 Drawing Figure

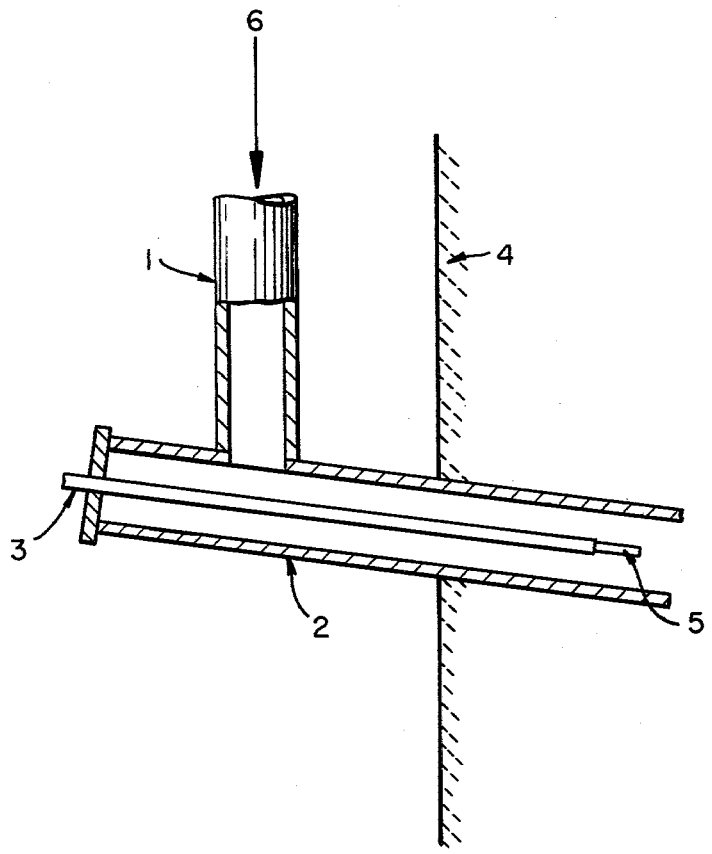
6
1
4
3
2
5

SUPERSONIC INJECTION OF OXYGEN IN CUPOLAS

BACKGROUND OF THE INVENTION

The conventional cupola is essentially a shaft furnace. At the bottom of the shaft is a well portion for collecting the molten metal and for initially receiving a bed charge coke. Closely spaced above the well are tuyeres for feeding large volumes of air under pressure. In the upper portions of the shaft there is provided a charge port. A cupola is employed in metal melting as opposed to metal refining processes.

Normal cupola operation is essentially simple. The vertical shaft furnace is packed with coke, which is caused to burn by air forced in the bottom through the tuyeres, producing heat. Metal, placed on top of the glowing coke bed, melts and drips through the coke, collecting in the well or hearth, where it is removed periodically through a tap hole.

When the incoming air, referred to in the art as the air blast, comes in contact with the burning coke, the latter is burned to carbon dioxide. This immediately reacts with further coke to form carbon monoxide, but in so doing absorbs about 45% of the heat emitted by the original carbon dioxide combustion reaction. As the carbon monoxide ascends through the column of coke and becomes cooler, some of it decomposes to carbon dioxide and carbon, an exothermic reaction.

The gases discharged from the shaft are thus a mixture of carbon monoxide, carbon dioxide and nitrogen. These hot discharged gases carry out about 10 percent of the heat produced by combustion of the coke. About 45 percent of the heat produced is removed by the molten metal, and the remaining 45 percent of the heat produced is used up by the afore-mentioned incomplete combustion reaction.

Those skilled in the art have devised several methods to alleviate the inefficiencies caused by this incomplete combustion. One such method has been to enrich the incoming air with oxygen. This method has given good results, but it is characterized by oxygen loss through leaks and some loss in the control of the chemistry of the molten metal.

Another method which has found wide use in the industry is the injection of extra oxygen directly into the burning coke. When oxygen is introduced in this manner, combustion is much more rapid near the hearth and the length of the zone of combustion tends to be less than with air alone. This causes the top of the coke bed to be somewhat cooler and this in turn causes a correspondingly greater decomposition of carbon monoxide to carbon dioxide and carbon, accompanied by a greater release of heat. This produces a hotter metal, a reduction in the amount of coke required per ton of metal and a higher carbon content in the metal. One such method is disclosed in U.S. Pat. No. 3,089,766 in which oxygen is injected directly into one or more tuyeres at velocities greater than that of the air blast. Another method is disclosed in British Pat. No. 914,904 in which oxygen is injected into the furnace through tuyeres located below the tuyeres through which air is introduced. Still another method is disclosed in British Pat. No. 1,006,274 in which oxygen is injected into the furnace through tuyeres located at the same level as the tuyeres through which air is introduced but in such a manner that the jets of air and oxygen impinge on different areas of the coke charge without substantial intermixing.

Because of the significant economic importance of the metal melting operation in cupolas a method which would improve the efficiency of the process over that heretofore obtained would be highly desirable.

OBJECTS

Accordingly it is an object of this invention to provide a more efficient method of melting metal in cupola.

It is another object of this invention to provide an improved method of melting metal in a cupola characterized by the injection of oxygen directly into the furnace.

SUMMARY OF THE INVENTION

The above and other objects which will be apparent to those skilled in the art are achieved by the present invention which comprises:

An improved process for producing molten metal in a cupola furnace comprising:

(a) charging coke and metal to the cupola furnace, (b) causing said coke to burn by the introduction of a first oxygen-containing gas, (c) additionally injecting directly into said cupola furnace a second oxygen-containing gas, having an oxygen concentration greater than said first oxygen-containing gas, said second oxygen-containing gas being injected at a flow rate equivalent to that required to enrich the oxygen concentration of said first oxygen-containing gas by from 0.5 to 10 percent; wherein the improvement comprises injecting said second oxygen-containing gas directly into said cupola furnace at a supersonic velocity.

The basic design and operation of a cupola are well known by those skilled in the art. Illustrative patents which describe cupolas and their operation include, for example, U.S. Pat. Nos. 3,089,766 and 4,045,212.

BRIEF DESCRIPTION OF THE DRAWING

FIG. 1 illustrates a preferred arrangement of apparatus suitable for practice of the process of this invention.

DESCRIPTION OF THE INVENTION

In practicing the present invention, the charging and firing of the cupola is carried out in a conventional manner. For example, the coke in the bottom of the cupola above the hearth is ignited, and the depth of the coke bed regulated by the amount of coke charged into the shaft furnace at the top. An oxygen-containing gas, such as air, is supplied to the cupola through the tuyeres. The cupola charge normally comprises a layer of coke and subsequent layers of metal and coke until the desired amount of material has been introduced. Additional quantities of metal and coke may be added as rapidly as the charge lowers within the shaft. Limestone or other fluxing material may be added to the top of each coke charge in order to reduce the viscosity of the cupola slag. During the operation of the cupola furnace, drops of molten metal flow down through the coke bed and collect between the lumps of coke in the well or crucible portion at the bottom of the cupola furnace. Likewise, the lighter molten slag accumulates within the coke bed below the tuyeres until it approaches the top of the crucible where it is discharged from the cupola through a slag spout. The molten metal is tapped from the cupola and allowed to run out through a tapping spout located at the base of the crucible below the slag spout.

As mentioned previously oxygen has been added to the oxygen-containing gas to enrich it. The oxygen-containing gas is usually air which has an oxygen content of about 21 percent. Oxygen or an oxygen-rich gas is added to the air at a flow rate such that the gas supplied to the cupola has the desired oxygen content. For example, if the oxygen content of the total gas supplied to the cupola is 23 percent, this is 2 percent enrichment.

The process of this invention supplies a second oxygen-containing gas directly to the cupola, as opposed to introducing this gas to the first oxygen-containing gas. The second oxygen-containing gas is provided to the cupola at a flow rate such that if it were provided to the first oxgen-containing gas it would result in from 0.5 to 10 percent enrichment. Of course, the second oxygen-containing gas must have an oxygen concentration greater than that of the first oxygen-containing gas.

The first oxygen-containing gas is generally, and preferably, air which has an oxygen concentration of about 21 percent. The second oxygen-containing gas has an oxygen concentration greater than the first oxygen-containing gas, generally from 50 to 100 percent oxygen, preferably from 90 to 100 percent oxygen, most preferably from 99 to 100 percent oxygen.

The improvement of the process of this invention is the injection of the second oxygen-containing gas directly into the cupola furnace at supersonic velocity. The injection of this gas at supersonic velocity results in several improvements in the operation of the cupola, such as greater combustion reaction penetration which results in decreased coke or fuel requirements to sustain the melting characteristics of the cupola, increased silicon recovery, higher carbon pickup, and cooler cupola walls.

The second oxygen-containing gas is injected directly to the cupola furnace separately from the first oxygen-containing gas. The injection of the second oxygen-containing gas may be through the same tuyere as the first oxygen-containing gas, or the injection may be through different tuyeres. If through different tuyeres, the tuyeres may be on the same level or on different levels as each other and may be on the same side of the cupola proximate to one another or on different sides as much as 180° apart from one another.

The second oxygen-containing gas impinges on the burning coke at supersonic velocity. If the first and second oxygen-containing gas are injected into the cupola furnace from positions proximate to one another, intermixing of the two gas streams may begin to occur before impingement on the burning coke. However, there need not be any intermixing of the two gas streams before such impingement.

As previously mentioned, the second oxygen-containing gas is injected at supersonic velocity, preferably at from 1200 to 3000 feet per second (365.9 to 914.6 meters per second) most preferably at from 1450 to 1650 feet per second (442.1 to 503.1 meters per second). For purposes of this application the speed of sound through dry air at 0° C. if taken to be 1087 feet per second (331.4 meters per second).

The second oxygen-containing gas is injected at a flow rate equivalent to that required to enrich the oxygen concentration of the first oxygen-containing gas by from 0.5 to 10 percent, perferably from 0.5 to 5 percent, most preferably from 1 to 4 percent.

The metal is charged to the cupola furnace as a solid. The metal may be any metal suitable for melting in a cupola furnace. Often the metal is a ferrous metal such as gray iron, scrap iron, pig iron or steel scrap.

One arrangement which can be used to practice the improved process of this invention is shown in FIG. 1. Those skilled in the art will readily understand that other arrangements will also be suitable. Referring now to FIG. 1, blast air 6 is introduced into tuyere 2 through conduit 1. Oxygen, at supersonic velocity is supplied through oxygen lance 3 which runs through the center of tuyere 2. The tuyere 2 and oxygen lance 3 run through cupola wall 4 into the cupola. The oxygen exits oxygen lance 3 through nozzle 5. Nozzle 5 may be any suitable nozzle; however, a preferred nozzle is a convergent-divergent nozzle since this type of nozzle helps to attain supersonic velocity. Thus, the substantially pure oxygen exits the oxygen lance 3 separate from the air blast, and is provided to the burning coke, at a supersonic velocity.

The following example will serve to illustrate the process of this invention. It is presented for illustrative purposes only, and is not intended to limit the scope of the present invention.

EXAMPLE 1

Gray iron and coke were charged to a conventional cupola furnace as in normal operation. The air blast was started and the coke ignited. Substantially pure oxygen having an oxygen concentration of about 99.5 percent was then injected directly into the cupola furnace by use of an apparatus such as shown in FIG. 1. The substantially pure oxygen was discharged from the oxygen lance through a convergent-divergent supersonic nozzle at a pressure of about 100 psig (8.06 kg/cm$^2$) and the oxygen was injected at a velocity of about 1520 feet per second (463.4 m/sec) at a flow rate of 22,000 standard cubic feet per hour (173 liters/sec). This flow rate was equivalent to about 2.5 percent enrichment.

After the iron melting was completed it was observed that the coke was burned away from the tuyere from 12 to 18 inches (30.5 to 45.7 cm), thus showing that oxygen injection at supersonic velocity results in improved combustion reaction penetration. Coke usage was reduced by about 20 pounds (9 kg) per charge over that which would be expected when employing conventional cupola operation. The temperature of the metal was from about 2825 (1552° C.) to about 2875° F. (1579° C.). Silicon recovery was very near 100 percent. The cupola water-wall was about 20°–30° F. (11°–17° C.) cooler than during conventional cupola operations. Furthermore, even after three days of operation, there was no need to use coke boosters of any kind.

What is claimed is:

1. In a process for producing molten metal in a cupola furnace comprising:

(a) charging coke and metal to the cupola furnace, (b) causing said coke to burn by the introduction of a first oxygen-containing gas, (c) additionally injecting directly into said cupola furnace a second oxygen-containing gas having an oxygen concentration greater than said first oxygen-containing gas, said second oxygen-containing gas being injected at a flow rate equivalent to that required to enrich the oxygen concentration of said first oxygen-containing gas by from 0.5 to 10 percent, the improvement comprising:

injecting said second oxygen-containing gas directly into said cupola furnace at a supersonic velocity.

2. The process of claim 1 wherein said second oxygen-containing gas is injected directly into said cupola furnace at a velocity of from 1200 to 3000 feet per second.

3. The process of claim 1 wherein said second oxygen-containing gas is injected into said cupola furnace at a velocity of from 1450 to 1650 feet per second.

4. The process of claim 1 wherein said second oxygen-containing gas has an oxygen concentration of from 50 to 100 percent.

5. The process of claim 1 wherein said second oxygen-containing gas has an oxygen concentration of from 90 to 100 percent.

6. The process of claim 1 wherein said second oxygen-containing gas has an oxygen concentration of from 99 to 100 percent.

7. The process of claim 1 wherein said second oxygen-containing gas is injected at a flow rate equivalent to that required to enrich the oxygen concentration of said first oxygen-containing gas by from 0.5 to 5 percent.

8. The process of claim 1 wherein said second oxygen-containing gas is injected at a flow rate equivalent to that required to enrich the oxygen concentration of said first oxygen-containing gas by from 1 to 4 percent.

9. The process of claim 1 wherein said metal is a ferrous metal.

10. The process of claim 1 wherein said metal is iron.

11. The process of claim 1 wherein said first oxygen-containing gas is air.

* * * * *